US007973624B2

(12) United States Patent
Kramer et al.

(10) Patent No.: US 7,973,624 B2
(45) Date of Patent: Jul. 5, 2011

(54) ELECTROMAGNETIC SWITCH FOR AN E-MACHINE

(75) Inventors: Claus Kramer, Besigheim (DE); Samir Mahfoudh, Buehl (DE)

(73) Assignee: Robert Bosch GmbH, Stuttgart (DE)

( * ) Notice: Subject to any disclaimer, the term of this patent is extended or adjusted under 35 U.S.C. 154(b) by 166 days.

(21) Appl. No.: 12/267,144

(22) Filed: Nov. 7, 2008

(65) Prior Publication Data

US 2009/0128266 A1 May 21, 2009

(30) Foreign Application Priority Data

Nov. 9, 2007 (DE) ..... 10 2007 053 417

(51) Int. Cl.
*H01H 67/02* (2006.01)

(52) U.S. Cl. ..... 335/126; 335/127; 335/131; 307/10.6

(58) Field of Classification Search ..... 335/126–131, 335/255, 256; 307/10.6
See application file for complete search history.

(56) References Cited

U.S. PATENT DOCUMENTS

| | | | | | |
|---|---|---|---|---|---|
| 4,720,639 | A | * | 1/1988 | Sakayanagi et al. | 290/38 R |
| 4,887,056 | A | * | 12/1989 | Kajino et al. | 335/126 |
| 4,916,423 | A | * | 4/1990 | Sugiyama | 335/278 |
| 4,987,369 | A | * | 1/1991 | Van Stapele et al. | 324/307 |
| 5,126,712 | A | * | 6/1992 | Sugiyama | 335/278 |
| 5,677,656 | A | * | 10/1997 | Mauch et al. | 335/126 |
| 6,937,123 | B2 | * | 8/2005 | Imanishi et al. | 335/126 |
| 7,639,108 | B2 | * | 12/2009 | Miyake | 335/126 |

FOREIGN PATENT DOCUMENTS

| | | |
|---|---|---|
| DE | 28 43 593 | 4/1980 |
| DE | 36 32 469 | 3/1988 |
| DE | 44 32 297 | 3/1996 |
| DE | 198 18 934 | 11/1999 |
| DE | 102 60 843 | 7/2004 |
| JP | 61-256706 | 11/1986 |
| JP | 2005/117459 | 4/2005 |
| JP | 2005-174590 | 6/2005 |

* cited by examiner

*Primary Examiner* — Anh T Mai
*Assistant Examiner* — Bernard Rojas
(74) *Attorney, Agent, or Firm* — Kenyon & Kenyon LLP

(57) ABSTRACT

An electromagnetic switch is described as including a starter relay, in particular, for an electrical starter motor for controlling a starter pinion when starting an internal combustion engine, having a housing, an armature electromagnetically controllable therein, for controlling a control lever, and having a flexible protective cap which seals a transition from the housing to the armature, the protective cap being developed to be pot-shaped and having a pot floor and a pot opening, the pot floor having a circular opening having a thickened ring for the form-locking connection to the armature, and the pot opening being developed reinforced at its circumferential edge for the form-locking connection to the housing, the pot floor having a setpoint bending region, as seen in cross section. In order to create a small installation space, the protective cap has an arrangement or structure, on its inner wall, for connecting to the housing, which are able to be connected to the housing in a form-locking manner.

12 Claims, 5 Drawing Sheets

ELECTROMAGNETIC SWITCH FOR AN E-MACHINE

RELATED APPLICATION INFORMATION

The present application claims priority to and the benefit of German patent application no. 10 2007 053417.7, which was filed in Germany on Nov. 9, 2007, the disclosure of which is incorporated herein by reference.

FIELD OF THE INVENTION

The present invention relates to an electromagnetic switch, a starter relay in particular, for an electrical starter motor for control, in order to bring a starter pinion into engagement when starting an internal combustion engine, having a housing, an armature of a control lever electromagnetically controllable therein, and having a flexible protective cap which seals a transition from a housing to the armature, the protective cap being developed to be pot-shaped and to have a pot opening and a pot floor, the pot floor having a circular opening having a thickened ring for the form-locking connection to the armature, and the pot opening is developed reinforced at its circumferential edge for the form-locking connection to the housing. The pot floor has a setpoint bending region, as seen in cross section. The present invention further relates to a fastening method of a protective cap for an electromagnetic switch, the protective cap connecting a housing and an armature in a sealing manner.

BACKGROUND INFORMATION

A protective cap (as discussed in the related art) may have a flange-shaped bead at its pot opening. Using the flange-shaped bead, the protective cap is fastened on the housing of an electromagnetic switch. A ring, which is screwed from outside onto the flange of the protective cap, creates a form-locking connection of the protective cap to the housing of the electromagnetic switch. Because of its elastic rubber material, the protective cap is also designated as a rubber bellows. The following related art is also known in this connection.

German patent document DE 102 60 843 A1 discusses a starter relay for engaging a starter pinion in a gear rim of an internal combustion engine, in order to switch a starter motor to starting. An elastic pot-shaped protective cap closes a free end of a controllable armature rod with the housing of the starter relay. The pot-shaped protective cap is developed in the form of expansion bellows in a fastening section of the housing. In the inserted state of the armature rod, the protective cap is pressed through. In the moved out state of the armature rod, the protective cap has a conical wall with respect to the armature rod.

Japanese patent document JP 2005-174590 A1 discusses an electromagnetic switch for starter motors having a pot-shaped protective cap.

The mounting of protective caps according to the related art is effortful, since it includes a multitude of components and assembly steps.

SUMMARY OF THE INVENTION

It is an object of the exemplary embodiments and/or exemplary methods of the present invention to refine an electromagnetic switch, of the type mentioned at the outset, in such a way that a simple assembly, having a long service life of the switch, is implemented in a minimum space while maintaining the sealing effect required.

According to the exemplary embodiments and/or exemplary methods of the present invention, this object is attained by the subject matter described herein. Further refinements of the exemplary embodiments and/or exemplary methods of the present invention are also described herein.

One idea of the exemplary embodiments and/or exemplary methods of the present invention is to facilitate and to simplify the assembly of the protective cap with the housing, by making fewer components required and thus a shorter production time is achieved.

The object may be attained by the protective cap, in order to connect to the housing, having a structure or arrangement at its inner wall that is able to be connected in a form-locking manner to the housing. Because the housing is able to be connected to the inner wall of the protective cap in a form-locking manner, one is able to avoid an effortful component-intensive and assembly-intensive production. An arrangement (or means or structure) that is able to be connected in a form-locking manner to the inner wall of the protective cap may be raised reliefs or recesses which are developed corresponding to recesses and raised reliefs in the housing.

The object is attained by a fastening method of a protective cap for an electromagnetic switch, having features described above and to be described below, in that the protective cap is slipped over an end of the housing that is developed as a cylindrical flange in a form-locking manner to form a form-locking connection, and, especially, the protective cap in the form-locking connection is held by a housing cover lying against the outer circumference wall of the protective cap which, in particular, presses the protective cap into the form-locking connection. The fastening method according to the present invention is able to be carried out rapidly and requires fewer components for fastening the protective cap onto an electromagnetic switch, compared to the related art.

According to one specific embodiment, the inner wall of the protective cap is developed in the region of the pot opening as an arrangement or structure that may be connected in a form-locking manner to a bead that is thickened as seen in cross section. The thickened bead at the inner wall of the protective cap may be fitted into a complementarily developed recess in an end of the housing developed as a cylindrical flange, to create a seal.

The bead on the inner wall of the protective cap is advantageously developed to be semicircular as seen in cross section, particularly doubly semicircular. Semicircular thickenings that protrude from the inner wall are simple geometric forms that enable a secure form-locking connection. These geometric forms are simple to produce and create a sufficient seal.

According to one specific embodiment that refines the exemplary embodiments and/or exemplary methods of the present invention, the bead at the inner wall of the protective cap is an M-shaped bead, as seen in cross section. The bead forms an exact geometric contour which is able to avoid a sliding back, or sliding out of the protective cap from the cylindrical flange of the housing in an even better manner.

In order to reinforce the form-locking connection between the protective cap and the housing, the outer wall of the protective cap is conically enlarged in the direction toward to pot opening, as seen in cross section, and is subsequently developed to have a uniform width in rectangular form. By such a reinforcement in the region of the pot opening, opposite to the protruding bead in the inner wall, a housing cover, for instance, that encompasses the outer wall of the protective cap is able to act on the outer wall, so that the form-locking connection of the flexible, elastic protective cap is additionally ensured, even in response to tensile stresses.

A circular opening in the pot floor of the protective cap encompasses the armature rod of the electromagnetic switch using a press fit. Normally, the protective cap folds itself to be round in a setpoint bending region. However, based on the minimum space conditions and the new form-locking connection between the protective cap and the housing it may happen that, when the armature rod is entered into the housing of the switch, corners may possibly develop, in a top view, for example, in a triangle on the protective cap. This leads to increased material fatigue, and thus to a more rapid destruction of the protective cap. Bulges in the protective cap may come into contact with the contour of the housing and the armature rod, and may thus cause increased wear and a service life reduction of the protective cap. These results occur because, when the armature is entered into the housing, as desired, the protective cap no longer folds uniformly roundly but folds so as to have corners. Thus, strongly folded corners develop. The development of strongly folded corners may also be illustrated in a force-displacement curve of a pot-shaped protective cap, whose force increases exponentially with respect to the displacement up to a maximum. In response to the maximum, the protective cap buckles, so-to-speak, and assumes a lower energy level as of the displacement at which the corners form and a counterforce working against a magnetically produced pull-in force of the armature is reduced.

According to a further essential idea that attains the object, the pot floor of the protective cap has at least two setpoint bending regions, as seen in cross section in the radial direction. The first setpoint bending region has a large diameter, especially a diameter corresponding to the outer diameter of the pot shape of the protective cap, and at least one second setpoint bending region has a smaller diameter than the pot shape of the protective cap and coaxially with the pot shape of the protective cap. The development of corners is securely avoided when the pot floor is entered into the pot-shaped protective cap, because of the two setpoint bending regions. By contrast to developed corners, a round fold creates no additional wear, so that the service life is advantageously long.

According to one specific embodiment refining the present invention, the pot floor has at least two bucklings at increasing motion displacement of the pot floor into the inside of the pot, in the case of a buckling, a counterforce generated by the flexible protective cap for a brief time goes back inwards with respect to the continuing motion displacement. According to the exemplary embodiments and/or exemplary methods of the present invention the big buckling in the rear region of the motion displacement of the pot floor, that has proved disadvantageous, is replaced by a plurality of small bucklings in the beginning and middle region of the motion displacement of the pot floor according to the present invention. These several small bucklings lead to a specified round fold from inside to outside, and do not lead to a negative jagged peak formation, such as the development of corners during the so-called unrolling of the protective cap. For the flexible round fold, the protective cap may be made of a silicon rubber material.

In one further specific embodiment, the pot floor has three bucklings, two rounded steps being developed in the pot floor, as seen in cross section in the radial direction, which are connected to an arched or conical connecting region. Such a protective cap has the advantage that the protective cap is developed in a manner that optimizes space and material.

In order to create a flexible, efficient seal between pot floor and armature, the circular opening in the pot floor is developed to have a closing and sealing ring that is circular as seen in cross section. The ring is freely pivotable by an angular range, in an angular groove on the armature, as seen in the radial direction. This brings with it the advantage of a long service life.

It is understood that the aforementioned features, which will be further explained below, are able to be used not only in the individually indicated combination but also in other combinations.

The exemplary embodiments and/or exemplary methods of the present invention is elucidated in greater detail below on the basis of exemplary embodiments, with reference to the drawings.

DETAILED DESCRIPTION

Figure 1:
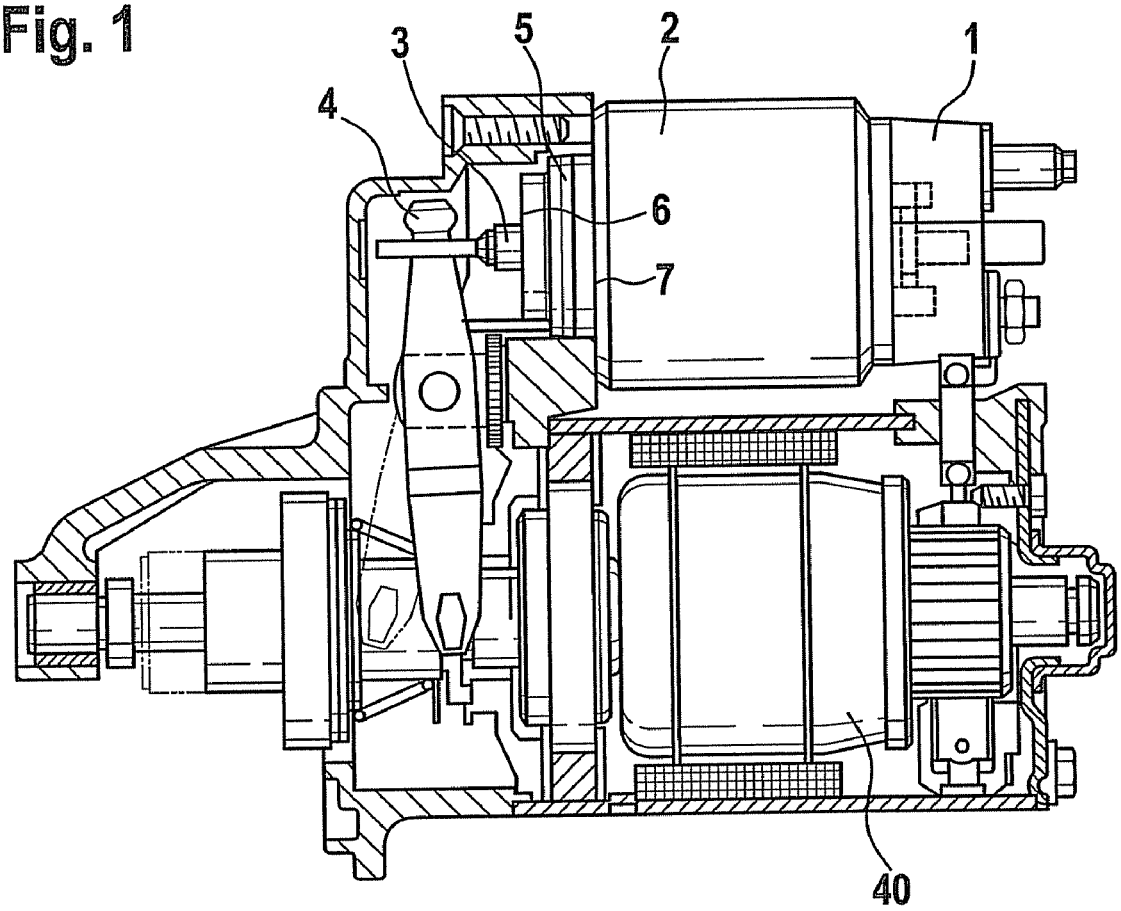
FIG. 1 shows a cross sectional view of a starter device.
Figure 2:
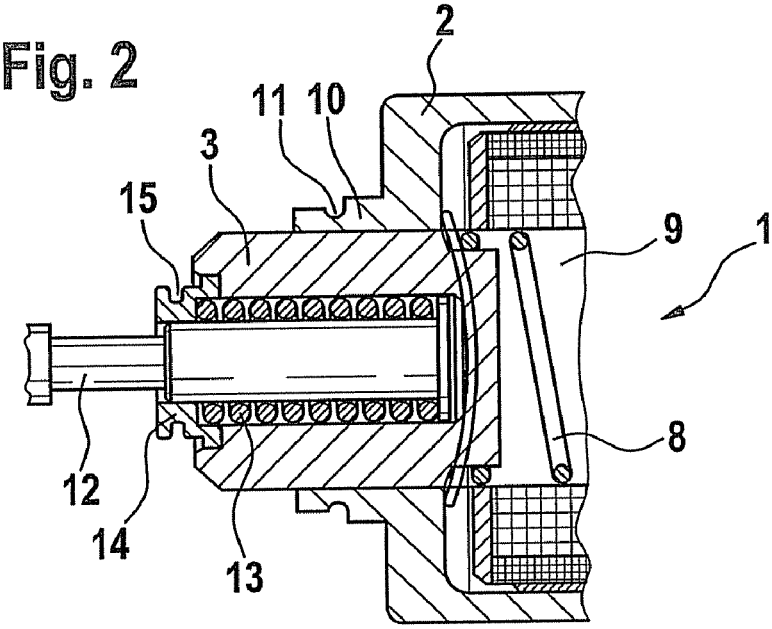
FIG. 2 shows an enlarged section of a cross sectional view of a starter relay without protective cap.

As seen in cross section, FIG. 1 shows a starting device for starting an internal combustion engine of a vehicle, having an electromagnetic switch which will be designated below as starter relay 1. Starter relay 1 includes a housing 2 having an electromagnetically controllable armature 3. Electromagnetic armature 3 is pushed out of housing 2 on one side using at least one spring 8 drawn in FIG. 2. When current is applied to starter relay 1, armature 3 is drawn into housing 2. On armature 3 there is a control lever 4 which puts a starter pinion of an electromagnetic starter motor 40 into engagement, so that an internal combustion engine is started in response to the operation of starter motor 40. In certain applications, e.g. in off-highway vehicles or in add-on situations, in which starter motor 40 is mounted on the internal combustion engine hanging downwards partially or all the way, the transition from housing 2 to armature 3 has to be sealed in order to prevent the penetration of moisture into starter relay 1, particularly in contact space 9 of armature 3 that is shown in FIG. 2. Corrosion in contact space 9 may lead to contact difficulties and corrosion in armature 3, and consequently, to a sluggish starter relay 1 or malfunctioning.

A flexible protective cap 5 made of a silicon rubber material is provided for making the seal. Protective cap 5 is developed to be pot-shaped. A pot floor 6 is connected sealingly to armature 3, and on the other side a pot opening 7 of protective cap 5 is sealed using housing 2.

FIG. 2 shows an enlarged section in a sectional representation of FIG. 1 of the transition between housing 2 and armature 3. Armature 3 is pushed out of magnetic contact space 9 by spring 8. This stressed state, having no current applied to it, is shown in FIG. 2. For the purpose of guiding armature 3, housing 2 has a cylindrical flange 10 which has an encircling housing groove 11 on its outer side. Housing groove 11 is developed in complementary fashion to a raised relief of the inner wall in the area of pot opening 7 of protective cap 5 shown in FIG. 3. A driving pin 12 having a meshing spring 13 is guided in armature 3. Driving pin 12 acts directly on control lever 4 shown in FIG. 1. A locking cap 14 locks meshing spring 13 in armature 3. Locking cap 14 has an encircling annular groove 15. Annular groove 15 accommodates a thickened ring 17 of a circular opening 16 in pot floor 6 or protective cap 5, as shown in FIG. 3.

Figure 3:
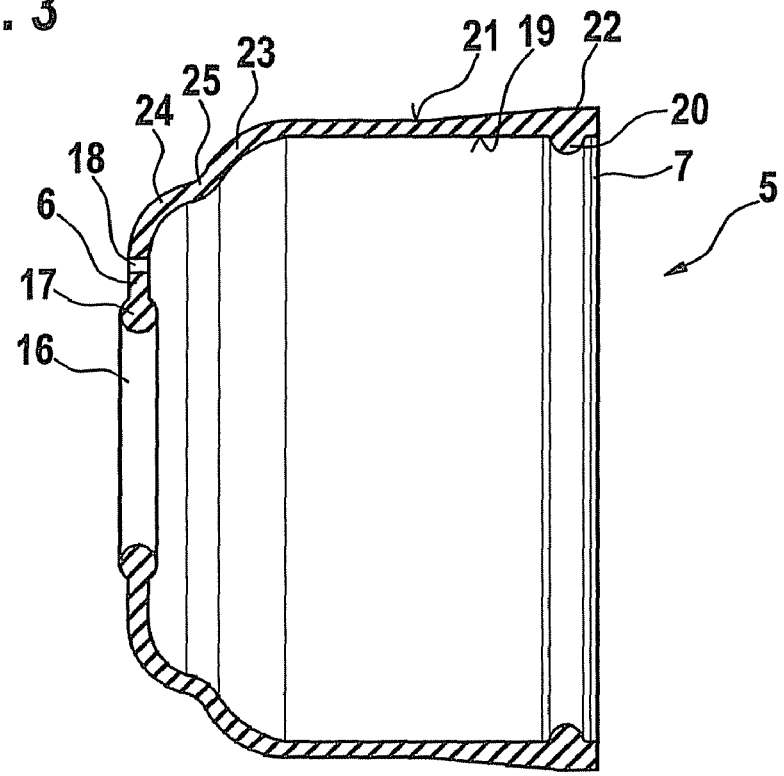
FIG. 3 shows a protective cap according to the present invention, in cross section.

FIG. 3 shows protective cap 5 according to the present invention, in a specific embodiment, in cross section. Protective cap 5 is developed to be essentially pot-shaped. Protective cap 5 has circular opening 16 in pot floor 6. Circular opening 16 is developed in pot floor 6 and has, as seen in cross section, a circular, closing ring 17 which seals armature 3. During the assembly of starter relay 1, ring 17 is set into annular groove 15 of locking cap 14 and fitted in. Pot floor 6 also has a compensating opening 18, for the purpose of letting gas volumes flow out of, or into protective cap 5 when pot floor 6 is moved in the direction into pot opening 7 or away from pot opening 7.

For the form-locking connection to housing 2, protective cap 5 has, on its inner wall 19, an annular bead 20, which is developed in the form of a semicircle as seen in cross section, that thickens pot opening 7.

In order to reinforce the circumferential edge in the area of pot opening 7, and thus to improve the sealing effect of protective cap 5, outer wall 21 is conically enlarged in the direction towards pot opening 7, as seen in cross section, and is subsequently developed at a cylindrical, uniform width, as seen in cross section, in a rectangular shape. Opposite bead 20, outer wall 21 is thus developed as cylindrical wall 22.

According to the exemplary embodiments and/or exemplary methods of the present invention, as seen in cross section, pot floor 6, in contrast to the related art, has not only one setpoint bending region in the radial direction, but at least two setpoint bending regions having a first and a second step 23, 24. In protective cap 5 that is made of a silicon rubber material, steps 23, 24 are rounded off and connected by a connecting region 25, that is rounded off, in a complementary manner to first and second steps 23, 24. Based on the two steps 23, 24 and connecting region 25 in pot floor 6, when pot floor 6 is drawn in, a defined round fold of pot floor 6 comes about, occupying a minimum space at the same time.

Figure 4:
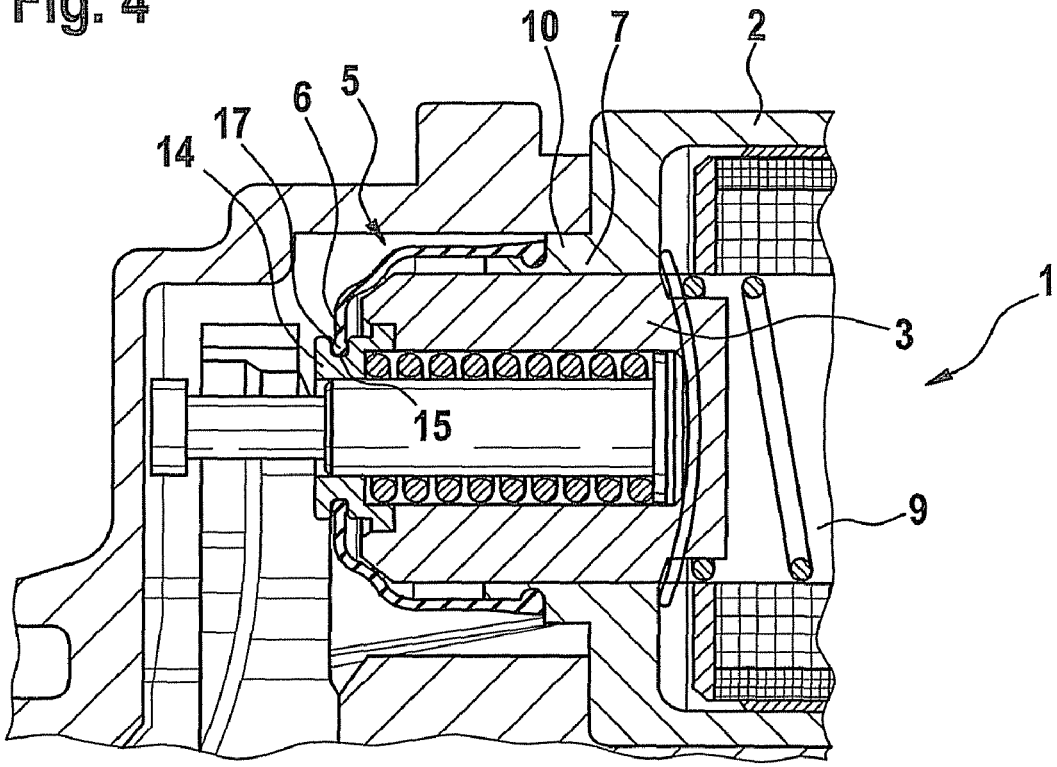
FIG. 4 shows an enlarged section of FIG. 2 having the protective cap.

FIG. 4 shows protective cap 5 according to the present invention in the installed state, in a cross sectional view of the section shown in FIG. 2. Ring 17 of pot floor 6 is located in annular groove 15 of locking cap 14. Pot opening 7 is connected with form-locking to cylindrical flange 10 of housing 2. FIG. 4 shows starter relay 1 having an armature 3 in the state in which no current is applied.

Figure 5:
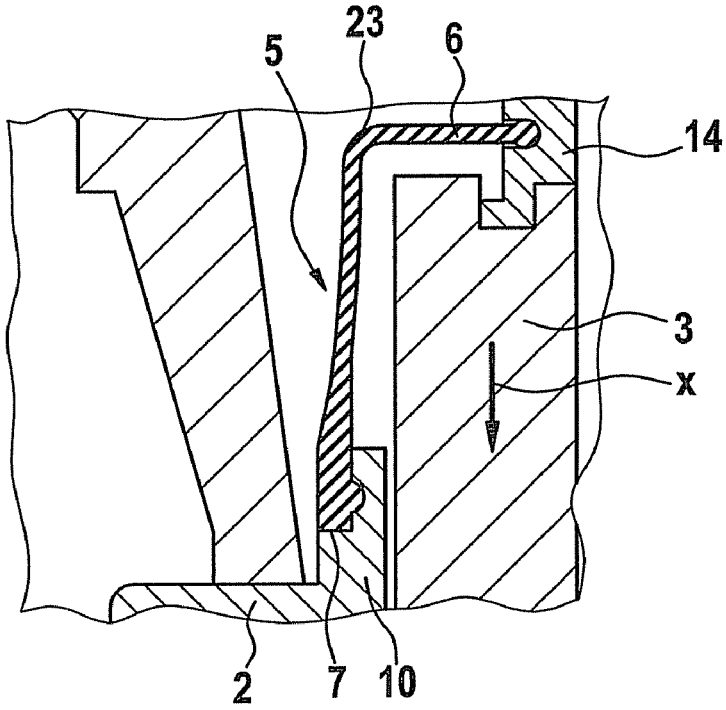
FIGS. 5 and 6 show a cross section of a first specific embodiment of the protective cap in an upper and a lower position.

FIG. 5 shows a radial cross section of a protective cap 5 according to the present invention, having a released armature 3. Protective cap 5, according to this specific embodiment, has the form-locking connection of pot opening 7 to cylindrical flange 10 of housing 2. Pot floor 6 has only one step 23, which produces a defined round bending according to FIG. 6, when armature 3, with locking cap 14, enters into contact space 9 shown in FIG. 4.

Figure 6:
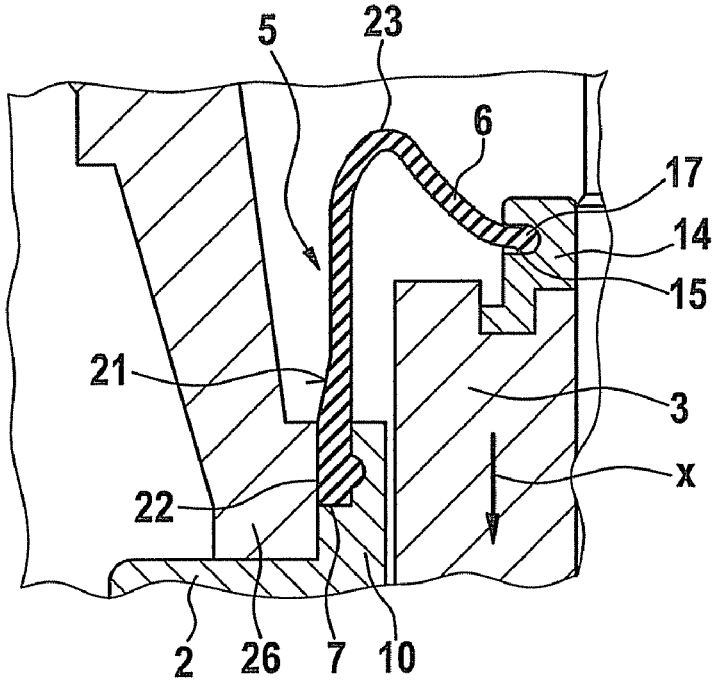

FIG. 6 shows protective cap 5 in an at least partially entered state of armature 3. Circular ring 17, as seen in cross section, is able to tilt in annular groove 15 of locking cap 14 at an angular range of at least 30 to 60°.

Cylindrical wall 22 of outer wall 21 closes flush with cylindrical flange 10 of housing 2. According to one special specific embodiment shown in FIG. 6, a cylindrical inner wall of a housing cover 26 is developed to lie directly against cylindrical wall 22, so that the form-locking connection of pot opening 7 to cylindrical flange 10, of housing 2, seals securely and cannot slip out.

FIG. 6 shows protective cap 5 having a round fold in the area of first step 23. It may happen, however, that, as of a certain path that still lies within the setpoint movement path, protective cap 5 does not develop uniformly round, but with strongly folded edges. This leads to material fatigue, and thus to a premature destruction of protective cap 5. On the other side, the bulges developed as corners come into contact with the contours of housing cover 26 or the drive-end bearing, that is, with control lever 4 that is developed as a fork. This may lead to a reduction in service life based on increased wear.

In one illustration of a power-displacement curve of such a pot-shaped protective cap 5, as of a certain displacement that is necessary for moving protective cap 5, the force decreases again. Protective cap 5 then buckles, and assumes a lower energy level.

Figure 7:
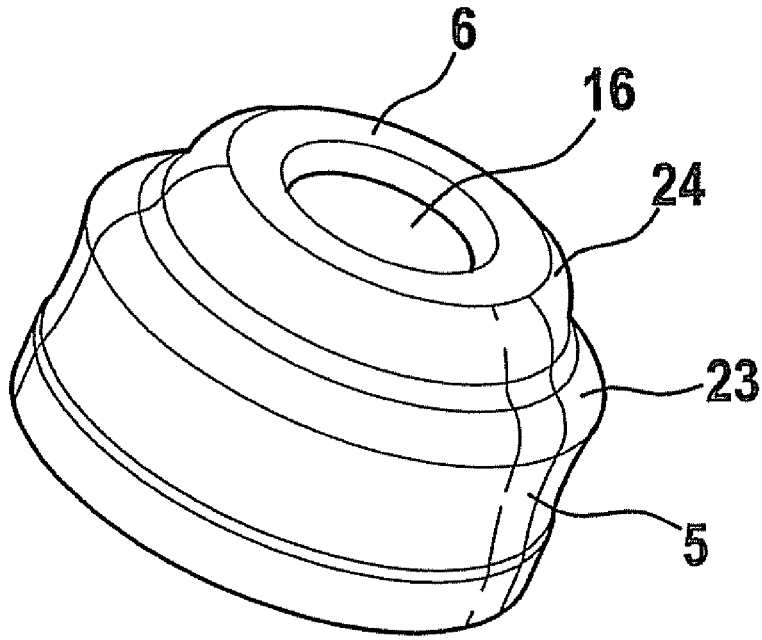
FIGS. 7 and 8 show a perspective view of the protective cap according to FIG. 3.

Therefore, according to the exemplary embodiments and/or exemplary methods of the present invention, as shown in FIG. 7 in a perspective view, protective cap 5 has two setpoint bending regions in the area of pot floor 6, having a first step 23 and a second step 24. In protective cap 5 shown in FIG. 7, circular opening 16 is only minimally moved. From annular opening 16 of pot floor 6, the wall of protective cap 5 first runs radially outwards, up to a diameter of first step 24, which is smaller than the final diameter of protective cap 5. At second step 24, the wall bends slantwise to the radius in the axial direction, in order then to approach the final outer diameter, in a steady transition, in step 23. In one special specific embodiment of first step 23, the wall thickness of protective cap 5 is able to increase steadily up to pot opening 7.

Figure 8:
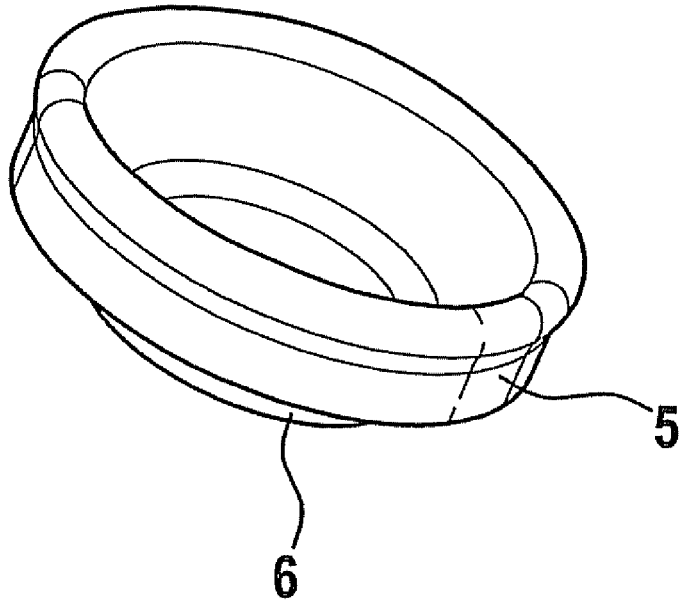

FIG. 8 shows protective cap 5 according to the present invention as in FIG. 7 in a perspective view, in the moved-in state of pot floor 6.

Figure 9:
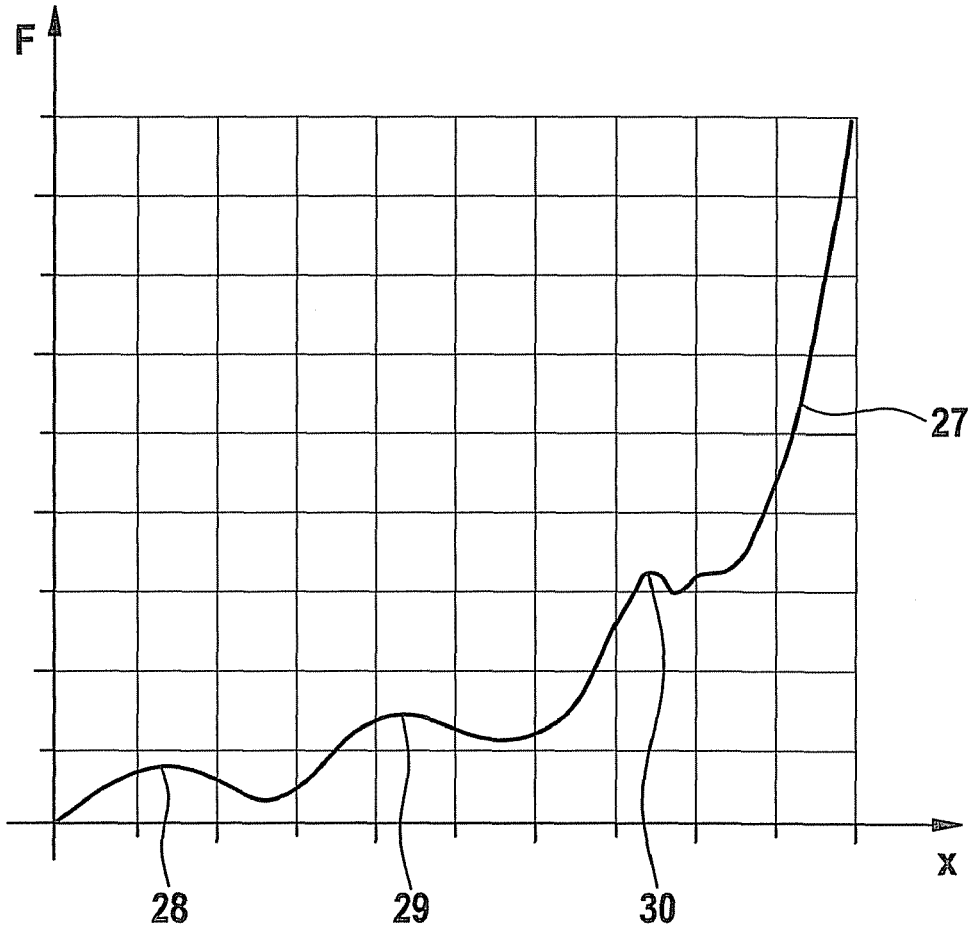
FIG. 9 shows a force-displacement curve of the protective cap as in FIG. 2.

FIG. 9 shows a power-displacement curve 27 of protective cap 5 according to the second specific embodiment. Power-displacement curve 27 shows that a counterforce F of protective cap 5 is magnified exponentially with increasing motion displacement x of pot floor 6 in the direction of pot opening 7. Protective cap 5 has an unrolling behavior having several smaller bucklings 28, 29 or 30. After a buckling, counterforce F, generated by flexible protective cap 5, with respect to advancing motion displacement x, decreases briefly. Protective cap 5 according to the present invention develops a round fold. Folded corners, for instance in triangular fashion, which lead to material fatigue and premature destruction of the protective cap, are avoided, according to force-displacement curve 27. One large buckling of pot-shaped protective cap 5 having only one setpoint bending region, at a first step, is replaced by a plurality of small bucklings 28, 29, 30. Small bucklings 28, 29, 30 lead to a round fold and not to a cornered deformation during the unrolling of pot floor 6.

Figure 10:
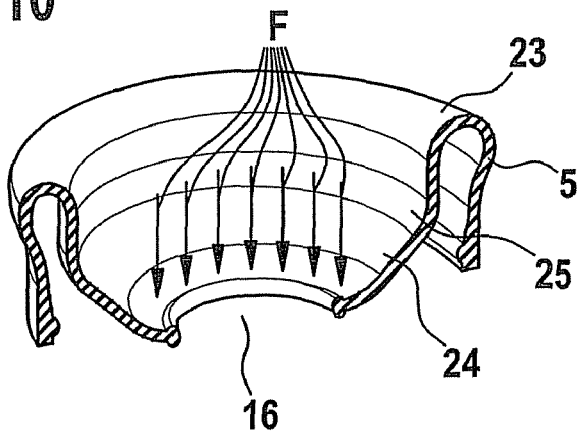
FIG. 10 shows a cross sectional view of the protective cap according to FIG. 8.

FIG. 10 shows a cross sectional view of protective cap 5 shown in perspective in FIG. 8. Circular opening 16 of the pot floor is pulled maximally inwards. First step 23 is folded round along its entire circumference, second step 24 is arched inwards or bent to be straight, and buckled in connecting region 25, in which the wall of pot floor 5, as seen in cross section, is bent at an angle to pot opening 7 and no longer bent from pot opening 7.

All the figures show only schematically illustrations that are not to scale. In all other respects, we refer especially to the drawings as being important representations of the present invention.

What is claimed is:

1. An electromagnetic switch for an electrical starter motor for providing control to bring a starter pinion into engagement when starting an internal combustion engine, comprising:

a housing;

an armature of a control lever electromagnetically controllable therein; and a flexible protective cap which seals a transition from a housing to the armature, the protective cap being pot-shaped having a pot opening and a pot floor, the pot floor having a circular opening having a thickened ring for providing a form-locking connection to the armature, and the pot opening being reinforced at its circumferential edge for the form-locking connection to the housing, the pot floor having a first bending region and a second bending region, in cross section, wherein the protective cap includes an arrangement, on its inner wall for connecting to the housing, which is connectable to the housing in a form-locking manner, each of the first and the second bending regions is radially stepped and contributes to a buckling behavior of the protective cap, such that when the pot floor is displaced inwards towards the housing, a plurality of bucklings produces a rounded folding of the pot floor.

2. The electromagnetic switch of claim 1, wherein the inner wall of the protective cap is thickened, in cross section, in the area of the pot opening, having a bead as a form-locking connectible arrangement.

3. The electromagnetic switch of claim 2, wherein the bead of the inner wall of the protective cap is semicircular, in cross section.

4. The electromagnetic switch of claim 2, wherein the bead of the inner wall of the protective cap is M-shaped, in cross section.

5. The electromagnetic switch of claim 1, wherein a first section of the outer wall of the protective cap is angled away from the inner wall and a second section of the outer wall nearest the pot opening runs parallel to the inner wall.

6. The electromagnetic switch of claim 1, wherein when the pot floor is in a maximally displaced position, the rounded folding of the pot floor is produced along the entire circumference of the first stepped bending region, a folding direction is opposite to the displacement direction, and a region connecting the first bending region to the second bending region is buckled towards a center of the circular opening.

7. An electromagnetic switch for an electrical starter motor to bring a starter pinion into engagement when starting an internal combustion engine, comprising:

a housing;

an armature, which is electromagnetically controllable therein, for controlling a control lever, and having a flexible protective cap which seals a transition from the housing to the armature, the protective cap being pot-shaped and having a pot floor and a pot opening, the pot floor having a circular opening having a thickened ring for a form-locking connection to the armature, and the pot opening being reinforced at its circumferential edge for the form-locking connection to the housing, the pot floor having a first bending region and a second bending region, wherein each of the first and the second bending regions is radially stepped and contributes to a buckling behavior of the protective cap, such that when the pot floor is displaced inwards towards the housing, a plurality of bucklings produces a rounded folding of the pot floor.

8. The electromagnetic switch of claim 7, wherein in response to each buckling, a counterforce, generated by the flexible protective cap, with respect to an advancing motion displacement inwards, decreases briefly.

9. The electromagnetic switch of claim 7, wherein the first and the second bending regions are connected by one of an arched connecting region and a conical connecting region.

10. The electromagnetic switch of claim 7, wherein the circular opening is in the pot floor and has, in cross section, a circular, closing and sealing ring.

11. A method for fastening a protective cap for an electromagnetic switch, the method comprising:

slipping the protective cap, which connects a housing and an armature in a sealing manner, over an end of the housing that is a cylindrical flange, in a form-locking manner in a form-locking connection;

wherein the electromagnetic switch is for an electrical starter motor for providing control to bring a starter pinion into engagement when starting an internal combustion engine, and includes:

a housing;

an armature of a control lever electromagnetically controllable therein; and a flexible protective cap which seals a transition from a housing to the armature, the protective cap being pot-shaped having a pot opening and a pot floor, the pot floor having a circular opening having a thickened ring for providing a form-locking connection to the armature, and the pot opening being reinforced at its circumferential edge for the form-locking connection to the housing, the pot floor having a first bending region and a second bending region, wherein the protective cap includes an arrangement, on its inner wall for connecting to the housing, which is connectable to the housing in a form-locking manner, and wherein each of the first and the second bending regions is radially stepped and contributes to a buckling behavior of the protective cap, such that when the pot floor is displaced inwards towards the housing, a plurality of bucklings produces a rounded folding of the pot floor.

12. The method of claim 11, wherein the protective cap is held in the form-locking connection by a housing cover that lies against an outer circumference of the wall of the protective cap, which pushes the protective cap into the form-locking connection.

* * * * *